US005691130A

United States Patent [19]

Buitano et al.

[11] Patent Number: 5,691,130

[45] Date of Patent: Nov. 25, 1997

[54] COLOR RECORDING PHOTOGRAPHIC ELEMENTS EXHIBITING AN INCREASED DENSITY RANGE, SENSITIVITY AND CONTRAST

[75] Inventors: Lois Ann Buitano; Richard Peter Szajewski, both of Rochester, N.Y.

[73] Assignee: Eastman Kodak Company, Rochester, N.Y.

[21] Appl. No.: 563,818

[22] Filed: Nov. 28, 1995

[51] Int. Cl.[6] ..... G03C 1/06

[52] U.S. Cl. ..... 430/611; 430/469; 430/487; 430/550; 430/564; 430/567; 430/502; 430/503; 430/599; 430/603; 430/607

[58] Field of Search ..... 430/469, 487, 430/550, 564, 567, 502, 503, 599, 603, 607, 611

[56] References Cited

U.S. PATENT DOCUMENTS

| | | | |
|---|---|---|---|
| 3,046,132 | 7/1962 | Minsk | 96/108 |
| 3,046,133 | 7/1962 | Minsk | 96/108 |
| 4,038,075 | 7/1977 | Pollet et al. | 96/22 |
| 4,292,400 | 9/1981 | Pollet et al. | 430/383 |
| 4,439,520 | 3/1984 | Kofron et al. | 430/434 |
| 5,041,367 | 8/1991 | Sniadoch | 430/603 |
| 5,310,635 | 5/1994 | Szajewski | 430/496 |
| 5,320,938 | 6/1994 | House et al. | 430/567 |
| 5,356,764 | 10/1994 | Szajewski et al. | 430/505 |
| 5,424,176 | 6/1995 | Schmittou et al. | 430/429 |
| 5,451,490 | 9/1995 | Budz et al. | 430/363 |
| 5,498,518 | 3/1996 | Brennecke | 430/569 |

*Primary Examiner*—Geraldine Letscher
*Attorney, Agent, or Firm*—Carl O. Thomas

[57] ABSTRACT

A color recording photographic element is disclosed containing a support and, superimposed on the support, blue, green and red recording layer units. The layer unit nearest the support contains a high chloride tabular grain emulsion and an optionally esterified glycolic ether having a molecular weight of at least 300 and containing at least one thioether moiety. The layer unit farthest from the support is free of the optionally esterified glycol compound. The advantages realized are an increased imaging density range, increased sensitivity, and increased contrast.

13 Claims, No Drawings

COLOR RECORDING PHOTOGRAPHIC ELEMENTS EXHIBITING AN INCREASED DENSITY RANGE, SENSITIVITY AND CONTRAST

FIELD OF THE INVENTION

The invention is directed to color recording photographic elements containing silver halide emulsions.

DEFINITIONS

The term "high chloride" in referring to silver halide grains and emulsions indicates a composition of greater than 50 mole chloride, based on silver.

In referring to grains and emulsions containing two or more halides, the halides are named in order of ascending concentrations.

The term "tabular" in referring to silver halide grains indicates grains having two parallel major faces, a ratio of maximum to minimum major face dimensions of less than 10, and an aspect ratio of at least 2, where aspect ratio is defined as the ratio of grain equivalent circular diameter divided by grain thickness (ECD÷t).

The term "tabular grain emulsion" indicates an emulsion in which tabular grains account for at least 50 percent of total grain projected area.

All subsequent occurrences of chemical formula symbols retain their initial definition, unless otherwise stated.

The term "glycolic ether" is employed to indicate a compound containing an ether moiety formed by the reaction of a glycol (HO—R—OH), thioglycol (HS—R—SH) or hemithioglycol (HO—R—SH), where R is a divalent optionally substituted hydrocarbon.

The term "thioether moiety" is employed to indicate R'—S—R", where R' and R" are optionally substituted hydrocarbon moieties.

The term "imaging density range" is defined as maximum density (Dmax) minus minimum density (Dmin).

Except as otherwise noted, photographic speed is herein measured at a density of 0.15 above Dmin.

Contrast (γ) is measured as the slope of a line drawn between the speed point (Dmin+0.15) and a characteristic curve point offset from the speed point by 0.6 log E, where E represents exposure in lux-seconds.

The term "color recording photographic element" is employed to indicate photographic elements that contain sufficient image information to allow the image and colors of the photographic subject to be reproduced, either within the color recording photographic element itself or in another color recording photographic element.

*Research Disclosure* is published by Kenneth Mason Publications, Ltd., Dudley House, 12 North St., Emsworth, Hampshire P010 7DQ, England

BACKGROUND

Color recording photographic elements as most commonly constructed contain, coated on a support, superimposed blue, green and red recording layer units. Each layer unit contains at least one silver halide emulsion layer. Color recording photographic elements are most commonly employed as (1) camera speed films that produce (a) color negative images or (b) color reversal (positive) images on a transparent film support or (2) reflection print elements that produce color positive images on a reflective (e.g., paper) support for direct viewing. An additional, emerging category of color recording photographic elements are those intended to be scanned to retrieve color record information for interim storage in a digital data base.

It is known that optionally esterified glycolic ethers having a molecular weight of at least 300 and containing at least one thioether moiety (hereinafter also referred to as thioether moiety containing glycolic ethers) are capable of acting as development accelerators in photographic elements. When present in reactive association with a silver halide emulsion during development these ethers have been observed to increase the sensitivity of the emulsion, even when the emulsion has been previously fully chemically sensitized. In most uses of these ethers significant increases in fog have been reported. Contrast variances, sometimes higher and sometimes lower, have also been reported. Minsk U.S. Pat. Nos. 3,046,132 and 3,046,133, Pollet et al U.S. Pat. Nos. 4,038,075 and 4,292,400, and Sniadoch U.S. Pat. No. 5,041,367 are illustrations of photographic elements containing these thioether moiety containing glycolic ethers.

High chloride tabular grain emulsions have been taught to be useful in color recording photographic elements by Kofron et al U.S. Pat. No. 4,439,520, Szajewski U.S. Pat. No. 5,310,635, House et al U.S. Pat. No. 5,320,938, Szajewski et al U.S. Pat. No. 5,356,764, and Budz et al U.S. Pat. No. 5,451,490.

SUMMARY OF THE INVENTION

In one aspect this invention is directed to a color recording photographic element comprised of a support and, superimposed on the support, blue, green and red recording layer units each containing at least one silver halide emulsion, wherein the layer unit nearest the support contains a high chloride tabular grain emulsion and an optionally esterified glycolic ether having a molecular weight of at least 300 and containing at least one thioether moiety and the layer unit farthest from the support is free of the thioether moiety containing glycolic ether.

It has been observed quite unexpectedly that these photographic elements demonstrate increased sensitivities, increased contrast and increased imaging density ranges with little or no significant increase in minimum density. Further, maximum observed improvements in performance have occurred with concentration levels, based on silver, of the thioether moiety containing glycolic ether in the layer unit nearest the support that are in excess of concentrations levels heretofore taught in the art.

When the thioether moiety containing glycolic ether is additionally or alternatively incorporated in the layer unit farthest from the support, the sensitivity of this layer unit is markedly decreased and fog levels are increased.

From further investigations of single emulsion layer coatings it has been observed that the performance characteristics produced by the thioether moiety containing glycolic ethers in high chloride tabular grain emulsions differs from those observed when high chloride nontabular grain emulsions or high bromide tabular grain emulsions are substituted.

DESCRIPTION OF THE PREFERRED EMBODIMENTS

A simple color recording photographic element satisfying the requirements of the invention can be constructed as follows:

| |
|---|
| Protective Overcoat |
| 3rd Color Recording Layer Unit |
| 2nd Interlayer |
| 2nd Color Recording Layer Unit |
| 1st Interlayer |
| 1st Color Recording Layer Unit |
| Undercoat |
| Support |
| Pelloid |
| Magnetic Imaging Layer |
| Element A |

The Support and the 1st, 2nd and 3rd Color Recording Layer Units are essential components for all color recording applications. The remaining components are either optional or required only in specific applications.

Each of the layer units records exposure in a different one of the blue, green and red portions of the visible spectrum. Any one of the following layer unit sequences are possible:

*SQ*-1 |B|G|R| *S* |,

*SQ*-2 |B|R|G| *S* |,

*SQ*-3 |G|R|B| *S* |,

*SQ*-4 |R|G|B| *S* |,

*SQ*-5 |G|B|R| *S* |, and

*SQ*-6 |R|B|G| *S* | where

B=Blue Recording Layer Unit,

G=Green Recording Layer Unit,

R=Red Recording Layer Unit, and

S=Support.

Each of the 1st, 2nd and 3rd Color Recording Layer Units contains at least one silver halide emulsion layer. In the simplest contemplated form of the invention each of the layer units is formed of a single silver halide emulsion layer.

It has been discovered that when (1) the color recording layer unit located nearest the support contains (a) a high chloride tabular grain emulsion and (b) a optionally esterified glycolic ether having a molecular weight of at least 300 and containing at least one thioether moiety and (2) the color recording layer unit located farthest from the support does not contain the thioether moiety containing glycolic ether, simultaneous increases in imaging density range, sensitivity, and contrast can be realized in all of the three color recording layer units.

The high chloride tabular grain emulsion can take any convenient conventional form. By definition high chloride tabular grain emulsions contain high (>50M %) chloride tabular grains accounting at least 50 percent of total grain projected area. It is preferred that the high chloride tabular grains account for at least 70 percent and, most preferably, at least 90 percent of total grain projected area. Ideally, the high chloride tabular grains account for substantially all (>97%) of total grain projected area. Rods are generally easily distinguished from tabular grains having {111} major faces. To distinguish tabular grains having {100} major faces for rods, the tabular grains are required to have a ratio of maximum to minimum major face dimensions of less than 10, preferably less than 5.

The high chloride tabular grains contain greater than 50 (preferably at least 70 and optimally at least 90) mole percent chloride, based on total silver. Tabular grains that consist essentially of silver chloride as the sole silver halide are specifically contemplated. Minor amounts of other halides can be present. Silver bromide and silver chloride are compatible in all ratios in a rock salt face centered cubic crystal lattice structure. Thus silver bromide can be present in the high chloride tabular grains in concentrations of up to 50 mole percent, based on total silver. Silver iodide does not alone form a rock salt face centered cubic crystal lattice structure under conditions relevant to photographic emulsion preparation. Silver iodide can under ordinary precipitation conditions be tolerated in a silver bromide crystal lattice structure in concentrations of up to 40 mole percent, based on total silver. Silver iodide can be tolerated in a silver chloride crystal lattice structure in concentrations of up to 13 mole percent, based on total silver. Maskasky U.S. Pat. Nos. 5,238,804 and 5,288,603 disclose elevated temperature precipitation techniques for increasing maximum iodide incorporation levels. It is contemplated that silver iodide can be present in the high chloride tabular grains in concentrations up to saturation levels. However, it is generally preferred to limit iodide concentrations in the high chloride tabular grains to 8 mole percent, based on total silver, or less.

It is generally preferred that the tabular grains in the high chloride tabular grain emulsions have an average aspect ratio of at least 5. Since aspect ratio is defined as ECD÷t, it is apparent that the average aspect ratios of the emulsions can vary widely, depending upon the particular selection of average grain size and tabular grain thickness. Average grain sizes can range up to about 10 μm for photographic applications, but average grain sizes rarely exceed 5 μm and are most commonly less than 3 μm. It is generally preferred that tabular grain thicknesses be less than 0.3 μm. Thin tabular grain emulsions, those having an average tabular grain thickness of less than 0.2 μm are preferred. It is specifically contemplated to employ high chloride ultrathin tabular grain emulsions—i.e., those having an average tabular grain thickness of <0.07 μm. Average aspect ratios commonly range from a preferred minimum of 5 to 100 or more, with average aspect ratios in the range of from 8 to 50 being most widely employed.

The high chloride tabular grains can have either {111} or {100} major faces. The following patents, the disclosures of which are here incorporated by reference, disclose high chloride {111} tabular grain emulsions and their preparation:

| | |
|---|---|
| Wey et al | U.S. Pat. No. 4,414,306; |
| Maskasky | U.S. Pat. No. 4,400,463; |
| Maskasky | U.S. Pat. No. 4,713,323; |
| Takada et al | U.S. Pat. No. 4,783,398; |
| Nishikawa et al | U.S. Pat. No. 4,952,491; |
| Ishiguro et al | U.S. Pat. No. 4,983,508; |
| Tufano et al | U.S. Pat. No. 4,804,621; |
| Maskasky | U.S. Pat. No. 5,061,617; |
| Maskasky | U.S. Pat. No. 5,178,997; |
| Maskasky and Chang | U.S. Pat. No. 5,178,998; |
| Maskasky | U.S. Pat. No. 5,183,732; |
| Maskasky | U.S. Pat. No. 5,185,230 |
| Maskasky | U.S. Pat. No. 5,217,858; |
| Chang et al | U.S. Pat. No. 5,252,452; |
| Maskasky | U.S. Pat. No. 5,298,387; |
| Maskasky | U.S. Pat. No. 5,298,388. |

The following patents, the disclosures of which are here incorporated by reference, disclose high chloride {100} tabular grain emulsions and their preparation:

| | |
|---|---|
| Maskasky | U.S. Pat. No. 5,264,337; |
| Maskasky | U.S. Pat. No. 5,292,632; |

-continued

| | |
|---|---|
| Brust et al | U.S. Pat. No. 5,314,798; |
| House et al | U.S. Pat. No. 5,320,938; |
| Chang et al | U.S. Pat. No. 5,413,904. |

The optionally esterified glycolic ether required to be incorporated in the layer unit nearest the support has a molecular weight of at least 300 and contains at least one thioether moiety. To maintain adequate mobility under development conditions it is generally preferred to limit the molecular weight of the thioether moiety containing glycolic ether to 10,000 or less.

Located at a minimum of a single location within the optionally esterified glycolic ether is a thioether moiety. In a specifically preferred form the thioether moiety satisfies the formula:

$$-(CH_2)_m-S-(CH_2)_n- \quad (I)$$

where m and n are independently selected integers, preferably ranging from 2 to 8.

The simplest possible glycolic ether, a polyglycol, can be transformed into a glycolic ether satisfying the requirements of the invention by replacement of one or more of its oxy (—O—) linkages with a divalent sulfur (—S—) linkage. Polyglycols with successive —O— groups replaced by —S— linkages are specifically contemplated. When two or more —S— linkages are located in the same polyglycol, it is preferred that the —S— linkages be separated by at least one —O— linkage. A synthetically simple way of accomplishing this is to incorporate into a linear polyglycol as the terminal groups thioether moieties. In a preferred form these thioether moieties satisfy the following formula:

$$-(CH_2)_m-S-(CH_2)_nO_pH \quad (II)$$

where p is zero or 1.

In another preferred form the thioether moiety (e.g., as shown in formula I) is located within the polyglycol chain and attached through two different —O— linkages. In another preferred form two thioether moieties, such as shown in formula I, are joined by a divalent —O— linkage and preferably attached through two different —O— linkages to the remainder of the atoms in the polyglycol chain. Thus, alternating —S— and —O— linkages in the polyglycols are specifically contemplated.

Although the thioether moiety containing glycolic ethers can consist entirely of glycol units with varied substitutions of —S— for —O— linkages as described above, the additional incorporation of other linking units is specifically contemplated. For example, variations having amino (e.g., —NQ—, where Q=H or $C_{1-8}$ alkyl) and —$SO_2$— linking units are known alternatives.

A preferred modification of the thioether moiety containing polyglycols described above is achieved by their terminal esterification with mono-basic carboxylic acids. Instead of or in addition to substituting —S— linkages for —O— linkages within the polyglycol moieties, thioether moieties, such as those satisfying formula I, can be incorporated within the esterified carboxylic acid moieties. This can be achieved by reacting with a polyglycol (optionally already containing at least one thioether moiety) with a thiacarboxylic acid, such as illustrated by the following formula:

$$R^1-S-(CH_2)_m-\overset{\overset{\displaystyle O}{\|}}{C}-OH \quad (III)$$

where $R^1$ is an optionally substituted hydrocarbon of from 1 to 18 carbon atoms, preferably alkyl of from 1 to 8 carbon atoms.

In one preferred form of the invention a dicarboxylic or thiadicarboxylic acid (e.g., $R^1$=—$(CH_2)_nC(O)OH$) is reacted with a glycol or polyglycol (the latter optionally containing at least one thioether moiety) to create a polyester containing at least one —S— linkage. Thioether moieties can be present solely within the glycolic ether moiety, solely within the esterified thiadicarboxylic acid moieties, or within both the glycolic ether and acid moieties of the polyester.

In a preferred form the polyesters useful in the practice of the invention contain repeating units satisfying the formula:

$$-O-\overset{\overset{\displaystyle O}{\|}}{C}-L^1-\overset{\overset{\displaystyle O}{\|}}{C}-O-L^2- \quad (IV)$$

where $L^1$ and $L^2$ are optionally substituted hydrocarbon (e.g., alkylene or thiaalkylene) linkages containing from 1 to 20 (preferably 1 to 8) carbon atoms, with the proviso that at least one of $L^1$ and $L^2$ contain a thioether moiety.

Optionally esterified glycolic ethers containing one or more thioether moieties contemplated for use in the practice of the invention are illustrated by Minsk U.S. Pat. Nos. 3,046,132 and 3,046,133, Pollet et al U.S. Pat. Nos. 4,038,075 and 4,292,400, and Sniadoch U.S. Pat. No. 5,041,367, the disclosures of which are here incorporated by reference.

The following specific compounds are illustrative of optionally esterified glycolic ethers containing at least one thioether moiety suitable for use in the practice of the invention.

$$H_3CSCH_2\overset{\overset{\displaystyle O}{\|}}{C}OCH_2CH_2S(CH_2CH_2O)_8CH_2CH_2SCH_2CH_2O\overset{\overset{\displaystyle O}{\|}}{C}CH_2SCH_3 \quad \text{TE-1}$$

$$H_3CSCH_2CH_2\overset{\overset{\displaystyle O}{\|}}{C}OCH_2CH_2S(CH_2CH_2O)_8CH_2CH_2SCH_2CH_2O\overset{\overset{\displaystyle O}{\|}}{C}CH_2CH_2SCH_3 \quad \text{TE-2}$$

$$HO(CH_2CH_2S)_2(CH_2CH_2O)_2CH_2CH_2(SCH_2CH_2)_2OH \quad \text{TE-3}$$

$$HO(CH_2CH_2S)_2(CH_2CH_2O)_3CH_2CH_2(SCH_2CH_2)_2OH \quad \text{TE-4}$$

$$HO(CH_2CH_2S)_2(CH_2CH_2O)_5CH_2CH_2(SCH_2CH_2)_2OH \quad \text{TE-5}$$

$$HO(CH_2CH_2S)_2(CH_2CH_2O)_8CH_2CH_2(SCH_2CH_2)_2OH \quad \text{TE-6}$$

-continued $HO(CH_2CH_2S)_2(CH_2CH_2O)_{12}CH_2CH_2(SCH_2CH_2)_2OH$ TE-7

$HO(CH_2CH_2S)_2(CH_2CH_2O)_{21}CH_2CH_2(SCH_2CH_2)_2OH$ TE-8

$HO(CH_2CH_2S)_2(CH_2CH_2O)_{33}CH_2CH_2(SCH_2CH_2)_2OH$ TE-9

$[HOCH_2C(OH)HCH_2SCH_2CH_2SCH_2CH_2O]_2CH_2CH_2$ TE-10

$[HOCH_2C(OH)HCH_2SCH_2CH_2S(CH_2CH_2O)_4]_2CH_2CH_2$ TE-11

$[XCH_2CH_2SCH_2CH_2S(CH_2CH_2O)_4]_2CH_2CH_2$ X = morpholino TE-12

$[HO(CH_2CH_2S)_3(CH_2CH_2O)_4]_2CH_2CH_2$ TE-13

$HO(CH_2CH_2S)_2(CH_2CH_2O)_7CH_3$ TE-14

$H_3CS\phi CO(CH_2CH_2O)_xC\phi SCH_3$ (O, O) TE-15

$\phi$ = phenylene; x corresponds to a polyglycol moiety molecular weight of 1500

$H_3C(CH_2)_3SCHCO(CH_2CH_2O)_xOCCHS(CH_2)_3CH_3$ (O, O; $HO(O)CH_2$, $CH_2C(O)OH$) TE-16 x corresponds to a polyglycol moiety molecular weight of 1500

$H_5C_2SCH_2NHCO(CH_2CH_2O)_xOCNHCH_2CH_2SC_2H_5$ (O, O) TE-17 x corresponds to a polyglycol moiety molecular weight of 1500

$H[OCH_2CH_2SCH_2CH_2OC(CH_2)_2C]_yOH$ (O, O) TE-18 y is chosen to provide an overall molecular weight of 4000 to 6000

$H[OCH_2CH_2SCH_2CH_2OC(CH_2)_3C]_yOH$ (O, O) TE-19 y is chosen to provide an overall molecular weight of 4000 to 8000

$H[OCH_2CH_2SCH_2CH_2OC(CH_2)_4C]_yOH$ (O, O) TE-20 y is chosen to provide an overall molecular weight of 3000 to 5000

$H[OCH_2CH_2SCH_2CH_2OC(CH_2)_6C]_yOH$ (O, O) TE-21 y is chosen to provide an overall molecular weight of 4000 to 8000

$H[O(CH_2CH_2S)_2CH_2CH_2OC(CH_2)_3C]_yOH$ (O, O) TE-22 y is chosen to provide an overall molecular weight of 4000 to 8000

$H[OCH_2CH_2CH_2SCH_2CH_2CH_2OC(CH_2)_2C]_yOH$ (O, O) TE-23 y is chosen to provide an overall molecular weight of 4000 to 8000

$H[OCH_2CH_2OCCH_2S(CH_2)_3SCH_2C]_yOH$ (O, O) TE-24 y is chosen to provide an overall molecular weight of 3000 to 5000

$H[OCCH(CH_2)_6CHCO(CH_2CH_2]_zOH$ (O, O; $H_5C_2S$, $SC_2H_5$) TE-25 z is chosen to provide an overall molecular weight of 2000 to 3000

The thioether moiety containing glycolic ethers as coated must be located in the layer unit coated nearest the support and must not be located as coated in the layer unit coated farthest from the support, although migration to this location may occur during processing. The inclusion of these glycolic ethers in layer units located in intermediate positions is optional.

Improvements in performance can be observed with concentrations of the thioether moiety containing glycolic ether in the layer unit nearest the support as low as 150 mg per mole of silver in the layer unit. Quite surprisingly, increased improvements in performance have been observed at concentrations greater than 3 grams per mole of silver in the layer unit. These are higher layer unit concentrations of the thioether moiety containing glycolic ethers than have been taught previously in the art. At the highest concentrations investigated further enhancements in performance have been demonstrated. Thus, the maximum concentrations of the glycolic ethers in the layer unit is believed to be determined by factors other than photographic performance, such as cost and the impracticality of adding unnecessary bulk to the layer unit composition. On this latter basis a practical upper limit on glycolic ether incorporation is contemplated to about be 15 grams per silver mole in the layer unit, with a typical preferred range of incorporation being in the range from >3 to 10 grams per mole of silver in the layer unit coated nearest the support.

The 2nd and 3rd Color Recording Layer Units can employ any conventional silver halide emulsion, but in most instances these color recording layer units also incorporate a high chloride tabular grain emulsion of the type described above. One notable exception is when SQ-3 or SQ-4 noted above are employed in a reflection print element, wherein a specifically contemplated construction is for the layer units other than the blue recording layer unit to employ a conventional high chloride nontabular (e.g., cubic or tetradecahedral) grain emulsion. However, even in this construction high chloride tabular grain emulsions in all layer units is feasible and specifically contemplated. Conventional emulsion choices beyond the high chloride tabular grain emulsions previously described are illustrated by the following:

*Research Disclosure*

Vol. 365, September 1994, Item 36544

I. Emulsion grains and their preparation

Vol. 370, February 1995, Item 37038

XIV. Emulsions

A. Tabular Grain Emulsions

B. Emulsion Dopants.

The emulsions can be chemically sensitized by any convenient conventional technique. Conventional chemical sensitizations are illustrated by the following:

Item 36544

IV. Chemical sensitization

Item 37038

XV. Emulsions

D. Emulsion Chemical Sensitization.

Preferred techniques for chemically sensitizing high chloride tabular grain emulsions are disclosed in the patents cited above to show conventional high chloride tabular grain emulsions.

The silver halide emulsions in the Blue, Green and Red Recording Layer Units contain blue, green and red absorbing spectral sensitizing dyes, respectively, adsorbed to the surfaces of the grains. To the extent that silver iodobromide emulsions are employed, the native blue sensitivity of these emulsions can be relied upon entirely for blue recording, although enhanced performance can be realized by the addition of one or more spectral sensitizing dyes. Any convenient conventional spectral sensitizing dye or combination of spectral sensitizing dyes can be employed in the layer units. Conventional spectral sensitizing dyes are illustrated by the following:

Item 36544

V. Spectral sensitization and desensitization

A. Sensitizing dyes

Item 37038

XV. Emulsions

E. Spectral Sensitization

F. Structures of Typical Sensitizing Dyes

Preferred spectral sensitizing dyes are disclosed in the patents cited above to show conventional high chloride tabular grain emulsions. Kofron et al U.S. Pat. No. 4,439,520 is here incorporated by reference for its extensive listing of blue spectral sensitizing dyes.

It is not essential that the Blue, Green and Red Recording Layer Units contain any image dye providing material. It is a common practice to introduce dye images into color reversal photographic elements by black-and-white development followed by sequential color development of the blue, green and red layer units using developers that contain dye image formers. Specific illustrations of these conventional imaging techniques are provided by the following:

Item 36544

XVIII. Chemical development systems

B. Color-specific processing systems Paragraph (1)

Most color negative films, color reversal films, and color print elements as well as photographic elements intended to produce images for scanning incorporate in the layer units dye image providing dyes or dye precursors. In a preferred form of the invention the Blue, Green and Red Recording Layer Units contain yellow, magenta and cyan dye image providing materials, respectively. The dye image providing materials can be incorporated directly within the emulsion layer or coated in a separate layer in reactive association (e.g., in contact) with the emulsion layer. Conventional dye image formers and modifying addenda are disclosed by the following:

Item 36544

X. Dye image formers and modifiers

Dye-forming couplers represent a specifically preferred class of dye image providing materials and are disclosed by the following:

Item 36544

X. Dye image formers and modifiers

B. Image-dye-forming couplers

Item 37038

II. Couplers

Ikenoue U.S. Pat. No. 5,254,446

Item 37038, Section II, paragraph E additionally discloses masking couplers, typically incorporated in color negative elements. Additional specific illustrations of dye-forming couplers are found in Szajewski U.S. Pat. No. 5,310,635, House et al U.S. Pat. No. 5,320,938, Szajewski et al U.S. Pat. No. 5,356,674, and Budz et al U.S. Pat. No. 5,451,490, the disclosures of which are incorporated by reference.

The layer units can contain a variety of additional addenda, such as illustrated by the following:

Item 36544

VII. Antifoggants and stabilizers

X. Dye image formers and modifiers

C. Image dye modifiers

D. Hue modifiers/stabilization

Item 37038

III. BARCs, Nucleating Agents, ETAs, Antifoggants, Scavengers

IV. Color Fog Inhibitors

V. Discoloration Inhibitors

VI. Polymeric Addenda

VII. Structures of Stabilizers and Scavengers

VIII. Dispersions

IX. Solvents

XIV. DI(A)RS

In a preferred construction the Layer Units each contain a development inhibitor releasing (DIR) compound, which is typically a coupler. When the DIR compound releases an inhibitor moiety having a free valence capable of bonding to silver (e.g., containing an organic moiety terminating in —$S^-$), the concentration of the DIR is limited to less than $3\times10^{-3}$ (preferably $<1\times10^{-3}$) per mole of silver in the Layer Unit. When the DIR is a dye-forming coupler, the dye formed can correspond in hue to the dye image produced on development. Alternatively, the dye formed can be used to perform a masking or other color modifying function.

The moiety released by the DIR can, as released, be directly available to serve a useful imaging function or can be initially blocked, requiring interaction with another agent, such as an electron transfer agent, to become actively available for performing its intended imaging function. It is specifically contemplated to employ DIR compounds in combination with bleach accelerator releasing compounds (BARCs).

The Protective Overcoat, the Layer Units, the Interlayers and the Undercoat all employ processing solution permeable vehicles. Conventional vehicle and vehicle related materials are disclosed in the following:

Item 36544

II. Vehicles, vehicle extenders, vehicle-like addenda and vehicle related addenda A. Gelatin and hydrophilic colloid peptizers B. Hardeners C. Other vehicle components Item 37038

XII. Hardeners

To facilitate coating, all of the coated layers additionally usually also contain at least some surfactant. Conventional surfactants are illustrated by the following:

Item 36544

IX. Physical property modifying addenda

A. Coating aids

Item 37038

XI. Surfactants

The Protective Overcoat particularly typically additionally contains the following types of materials:

Item 36544

IX. Coating physical property modifying addenda

B. Plasticizers and lubricants

C. Antistats

D. Matting agents

Item 37038

X. UV Stabilizers

Antistats and matting agents can be present in other coated layers, but are usually associated with an outmost layer of the color recording photographic elements.

The Interlayers contain oxidized developing agent scavengers to prevent color developing agent oxidized in one layer unit from forming an image dye in an adjacent layer unit. Illustrations of interlayer scavengers are included in the following:

Item 37038

III. BARCs, Nucleating Agents, ETAs, Antifoggants, Scavengers

VII. Structures of Stabilizers and Scavengers

Any one of the Interlayers and the Undercoat can additionally contain processing solution decolorizable absorbing materials to control direct exposure of the underlying layer units or reflection reexposure (halation) of the overlying layer units. Carey Lea (yellow colloidal) silver or yellow filter dye is commonly used to protect red and green recording layer units that contain an emulsion having significant native blue sensitivity from unwanted blue exposure. When high chloride emulsions are employed in the layer units, blue absorbing filter dyes can be entirely eliminated, since silver chloride has little native blue sensitivity. The Undercoat is a preferred location for antihalation dyes. Occasionally, a processing solution decolorizable absorbing material is coated in the Protective Overcoat to reduce the speed of a photographic element. Processing solution decolorizable absorbing materials and their use are illustrated by the following:

Item 36544

VIII. Absorbing and scattering materials

B. Absorbing materials

C. Discharge

Item 37038

XIII. Filter and Absorber Dyes

The Support can take any convenient conventional form. In a specifically preferred form for camera speed elements the support is a transparent film support. For reflection print elements the support is preferably a white reflective support of the type referred to as photographic paper, although it need not have any actual paper content. Conventional photographic supports are illustrated by the following:

Item 36544

X. Supports

It is not necessary that any coating be present on the back side (the side opposite the layer units) of the support. In Element A a Pelloid is shown to be present. The Pelloid can be coated using the same types of vehicles used to form the coated layers previously described. The Pelloid can be provided to act as an anticurl layer, at least partially offsetting the forces exerted on the front side of the Support by the other coated layers. When the Support is transparent, the Pelloid also represents a second preferred location for antihalation dyes of the type described above. For example, with antihalation dye located in the Pelloid, it is possible to entirely dispense with the Undercoat and still realize high levels of image sharpness. This is because the largest mismatch in refractive indices encountered by exposing light and hence the highest reflection occurs at the interface of the Support and air on the back side of the support. Antistatic addenda, noted above in connection with the Protective Overcoat, can be additionally or alternatively located in the Pelloid.

The Magnetic Imaging Layer is an optional, but preferred layer having as its purpose to store information about the photographic element for use in exposure or subsequent processing. Magnetic imaging layers are illustrated by the following:

Item 36544

XIV. Scan facilitating features Paragraph (2)

James U.S. Pat. Nos. 5,254,441 and 5,254,449

When image information is intended to be read from the photographic elements of the invention by reflection and/or transmission scanning, it is entirely feasible, but no longer of any importance, to form an image that is pleasing to the eye, as in color reversal or reflection print elements, or to form a negative image that can be exposed through to obtain a visually pleasing positive image, as in most color negative films. It is merely necessary that the 1st, 2nd and 3rd Layers Units when exposed and processed contain a retrievable record of the subject, including its color. False color records are just as useful for this purpose as natural color records, and it is, in fact, possible to form retrievable color records without actually forming a dye image. Color negative films intended solely for scanning do not require masking couplers. Bohan U.S. Pat. No. 5,434,038 discloses a color negative film containing a masking coupler that is equally suited for image retrieval by printing or scanning. Color recording photographic element constructions specifically adapted for the scan retrieval of image information are illustrated by the following:

Item 36544

XIV. Scan facilitating features Paragraph (1)

In addition, the disclosures of the following more recently issued patents of color recording photographic element constructions particularly adapted for scan image retrieval are here incorporated by reference: Sutton et al U.S. Pat. Nos. 5,300,413 and 5,334,469, Sutton U.S. Pat. Nos. 5,314,794 and 5,389,506, Evans et al U.S. Pat. No. 5,389,503, Simons et al U.S. Pat. No. 5,391,443, Simons U.S. Pat. No. 5,418,119 and Gasper et al U.S. Pat. No. 5,420,003.

In addition it has been a long standing practice in the art to modify an edge of color recording film to provide an information record entirely separate from the color image record. For example, edge sound tracks are frequently provided on motion picture films. Modified edge region constructions are illustrated by the following:

Item 36544

XIV. Scan facilitating features Paragraph (3)

In the foregoing discussion the color recording photographic elements have been discussed by reference to 1st, 2nd and 3rd Layer Units each containing a single silver halide emulsion contained in a single layer. In fact, it is quite common to prepare emulsion layers by blending emulsions to realize photographic aim properties. It is also quite common to coat two or three emulsions differing in photographic speed in a single layer unit. By coating a faster emulsion as a separate layer over (closer to the source of exposing radiation) than a slower emulsion, a higher speed is realized than when the two emulsions are blended. Additionally, when the faster emulsion layer contains less than a stoichiometrically indicated amount of the dye image providing component (e.g., the faster emulsion layer is dye-forming coupler starved), not only is faster speed realized than by blending, but granularity can be lower than predicted from emulsion blending. When the layer order is reversed, a higher contrast is realized than when the two emulsions are blended. Variations of emulsion blending and layer arrangements within a single emulsion layer unit are illustrated by the following:

Item 36544

I. Emulsion grains and their preparation

E. Blends, layers and performance categories

As an alternative to constructing a color recording photographic element with single blue, green and red recording layer units, it is common practice to provide two or even three layer units for recording in the same region of the spectrum. The most common reason for these constructions is to allow the fastest emulsion for recording in a particular region of the spectrum to receive exposing light prior to transmission through the slower emulsion layers of other layer units. This increases speed and image sharpness. Color recording photographic elements having varied arrangements of layer units, including at least two separate layer units for recording exposure to the same region of the spectrum are illustrated by the following:

Item 36544

XI. Layers and layer arrangements

The following are illustrative of only a few of the many possible additional layer unit sequences including at least two layer units for recording exposures to the same region of the spectrum:

SQ-7 |B|Gf|Rf|Gs|Rs| S |,

SQ-8 |Bf|Gf|Rf|Bs|Gs|Rs| S |,

SQ-9 |B|Gf|Rf|Gm|Rm|Gs|Rs| S |,

SQ-10 |Gf|Rf|Bf|Gs|Rs|Bs| S |,

SQ-11 |Gf|Rf|Bf|Gm|Rm|Bm|Gs|Rs|Bs| S |, and

SQ-12 |Rf|B|Gf|Rf|Gs|Rs| S | where

B, G, R and S are as defined above, f=higher or highest speed of layer units recording in the same region of the spectrum, m=intermediate speed of layer units recording in the same region of the spectrum, s=slower or slowest speed of layer units recording in the same region of the spectrum.

In SQ-12 two Rf layer units are shown. The Rf layer unit farthest from the support contains a much lower silver halide coating coverage than the remaining Rf layer unit and is sometimes referred to as a skim coat. Its function is offer a small speed boost to the red record to compensate for the otherwise less favorable for speed and sharpness locations of the red recording layer units as compared to the green recording layer units.

More specific illustrations of color recording layer units that can be readily modified by the inclusion of one or more high chloride tabular grain emulsions and a thioether moiety containing glycolic ether are provided by the following:

Item 37038

XVI. Color Paper Embodiments

XVII. Color Paper Example 1

XVIII. Color Paper Example 2

XIX. Color Negative Example 1

XX. Color Negative Example 2

XXI. Color Reversal Example 1

XXII. Color Reversal Example 2

Color recording photographic elements are typically employed to record exposures over the full range of the visible spectrum. Occasionally color recording photographic elements are employed to record also exposures in the near ultraviolet and/or near infrared portions of the spectrum. When this is undertaken, an additional layer unit can be provided for this purpose. Any convenient conventional technique for imagewise exposing and subsequently processing the color recording photographic elements of the invention is contemplated. Typical convenient conventional techniques are illustrated by the following:

Item 36544

XVI. Exposure

XVII. Chemical development systems

A. Non-specific processing features

B. Color-specific processing features

XIX. Development

A. Developing Agents

B. Preservatives

C. Antifoggants

D. Sequestering Agents

E. Other additives

XX. Desilvering, washing, rinsing and stabilizing

A. Bleaching

B. Fixing

C. Bleach-Fixing

D. Washing, rinsing and stabilizing

Item 37038

XXIII. Exposure and processing

A. Color Paper Processing

B. Color Film Processing

Koboshi U.S. Pat. No. 4,814,260

Southby U.S. Pat. No. 5,302,498

Kobayashi U.S. Pat. No. 5,354,646

Szajewski et al U.S. Pat. No. 5,356,764

Szajewski et al U.S. Pat. No. 5,443,943

Budz et al U.S. Pat. No. 5,451,490

The disclosures of each of the six U.S. Patents cited immediately above are here incorporated by reference. Szajewski et al, both citations, and Budz et al specifically disclose exposure and processing of high chloride tabular grain emulsion containing color recording photographic elements.

Exposure of camera speed color recording photographic elements in limited use and recyclable cameras is specifically contemplated. Limited use camera and incorporated film constructions are the specific subject matter of Item 36544, Section XVI Exposure, cited above, paragraph (2), and Sowinski et al U.S. Pat. No. 5,466,560, the disclosure which is here incorporated by reference. Spooled films containing high chloride tabular grain emulsions are specifically disclosed in Szajewski U.S. Pat. No. 5,310,635, the disclosure of which is here incorporated by reference.

Although *Research Disclosure*, Items 36544 and 37038, have been used to provide specific illustrations of conventional color recording photographic elements, their components, exposure and processing, it is recognized that numerous other publications also disclose conventional features, including the following:

James *The Theory of the Photographic Process*, 4th Ed., Macmillan, New York, 1977;

*The Kirk-Othmer Encyclopedia of Chemical Technology*, John Wiley and Sons, New York, 1993;

Neblette's *Imaging Processes and Materials*, Van Nostrand Reinhold, New York 1988; and Keller, *Science and Technology of Photography*, VCH, New York, 1993.

EXAMPLES

The invention can better appreciated by reference to the following specific examples. The coating coverages of silver halide are based on silver. All coating coverages are shown parenthetically in g/m$^2$, except as otherwise noted. Spectral sensitizing dyes were employed in substantially optimum sensitizing concentrations. Mean grain sizes (ECD) and thicknesses (t) are reported in micrometers (μm).

EXAMPLE 1

Five (5) color recording photographic elements were constructed differing in their inclusion of thioether moiety containing glycolic ether. The general layer arrangement of all elements was as follows:

| |
|---|
| Protective Overcoat (13) |
| UV Protective Layer (12) |
| Blue Recording Layer Unit |
| Faster Blue Recording Emulsion Layer (11) |
| Slower Blue Recording Emulsion Layer (10) |
| 2nd Interlayer (9) |
| Green Recording Layer Unit |
| Fastest Green Recording Emulsion Layer (8) |
| Mid-Speed Green Recording Emulsion Layer (7) |
| Slowest Green Recording Emulsion Layer (6) |
| 1st Interlayer (5) |

-continued

| |
|---|
| Red Recording Layer Unit |
| Fastest Red Recording Emulsion Layer (4) |
| Mid-Speed Red Recording Emulsion Layer (3) |
| Slowest Red Recording Emulsion Layer (2) |
| Undercoat (1) |
| Support |
| 100 Series Elements |
| Support |
| Transparent cellulose acetate film support. |
| Undercoat |
| DYE-6 (0.11); DYE-9 (0.075); SOL-1 (0.011); SOL-2 (0.011); and gelatin (1.6) |
| Red Recording Layer Unit |

Slowest Red Recording Emulsion Layer

EM-1 (0.22) sensitized with SS-1+SS-2, 2:1 molar ratio; EM-1 (0.21) sensitized with SS-2; C-53 (0.51); D-1 (0.004); D-32 (0.001); ST-16 (0.01); B-1 (0.043); and gelatin (1.18)

Mid-Speed Red Recording Emulsion Layer

EM-2 (0.21) sensitized with SS-1+SS-2, 2:1 molar ratio; EM-4 (0.21) sensitized with SS-1+SS-2, 2:1 molar ratio; C-53 (0.16); D-1 (0.005); D-32 (0.001); ST-16 (0.01); and gelatin (0.65)

Fastest Red Recording Emulsion Layer

EM-3 (0.70) sensitized with SS-2+SS-3, 9:1 molar ratio; C-53 (0.11); D-1 (0.002); D-32 (0.001); ST-16 (0.01); and gelatin (1.1)

1st Interlayer

ST-4 (0.11) and gelatin (0.75)

Green Recording Layer Unit

Slowest Green Recording Emulsion Layer

EM-1 (0.16) and EM-2 (0.16) each sensitized with SS-4+SS-5, 6:1 molar ratio; C-2 (0.38); D-1 (0.011); D-34 (0.001); ST-5 (0.1); ST-16 (0.01); and gelatin (1.18)

Mid-Speed Green Recording Emulsion Layer

EM-2 (0.16) and EM-4 (0.22) each sensitized with SS-4+SS-5, 6:1 molar ratio; C-2 (0.075); D-1 (0.003); D-34 (0.001); ST-5 (0.018); ST-16 (0.01); and gelatin (0.44)

Fastest Green Recording Emulsion Layer

EM-3 (0.70) sensitized with SS-4+SS-5, 6:1 molar ratio; C-15 (0.172); D-1 (0.002); D-34 (0.001); ST-16 (0.01); and gelatin (0.89)

2nd Interlayer

ST-4 (0.11) and gelatin (0.75)

Blue Recording Layer Unit

Slower Blue Recording Emulsion Layer

EM-2 (0.16) and EM-5 (0.11) each sensitized with SS-6+SS-7, 1:1 molar ratio; C-54 (0.86); D-34 (0.001); D-35 (0.01); ST-16 (0.01); and gelatin (0.76)

Faster Blue Recording Emulsion Layer

EM-6 (0.86) sensitized with SS-8+SS-9, 3.4:1 molar ratio; C-54 (0.27); D-34 (0.001); D-35 (0.003); ST-16 (0.01); and gelatin (0.86)

First Protective Layer

DYE-8 (0.1); DYE-9 (0.1); and gelatin (0.7)

Second Protective Layer

Silicone lubricant (0.04); tetraammonium perfluorooctane sulfonate (0.1); anti-matte poly(methyl methacrylate) beads (0.11); anti-matte polystyrene beads (0.005); and gelatin (0.89)

The emulsions were each sulfur and gold sensitized AgICl tabular grain emulsions containing 99.4M % Cl and 0.6M % I, based on silver. The emulsions were prepared with the dump addition of iodide after at least 50% of total silver had been precipitated according to the teachings of Brust et al U.S. Pat. No. 5,314,798. The emulsions were prepared with differing mean ECD's to obtain a range of photographic speeds. The differences in grain sizes are summarized in Table I.

TABLE I

| Emulsion | ECD | t |
|---|---|---|
| EM-1 | 0.6 | 0.06 |
| EM-2 | 0.9 | 0.09 |
| EM-3 | 3.0 | 0.14 |
| EM-4 | 1.4 | 0.14 |
| EM-5 | 1.0 | 0.10 |
| EM-6 | 3.5 | 0.15 |

The following listing provides the structures of the 100 Series color recording elements ingredients identified above by descriptors:

B-1

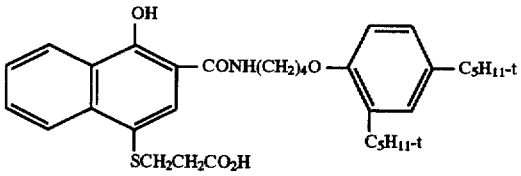

C-2

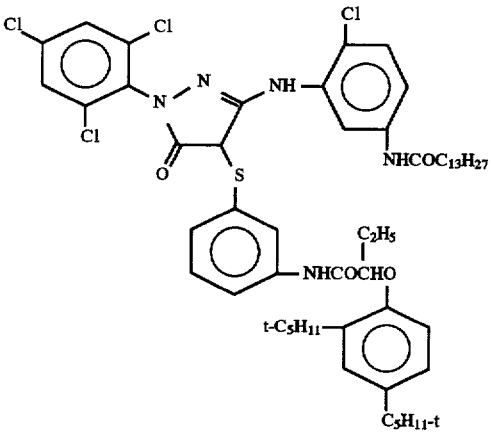

C-53

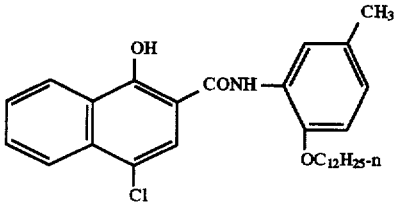

C-54

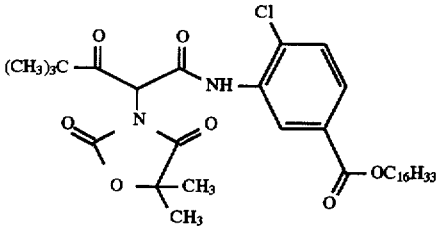

-continued

D-1

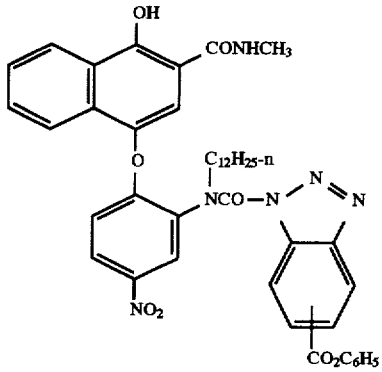

D-32

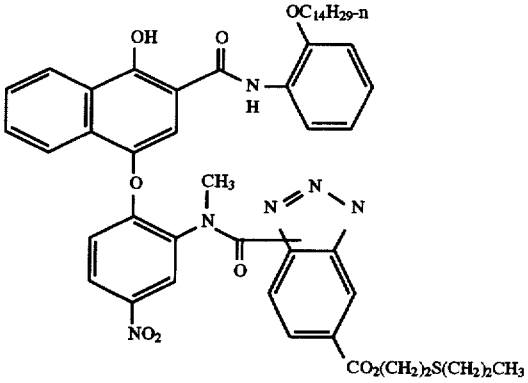

D-34

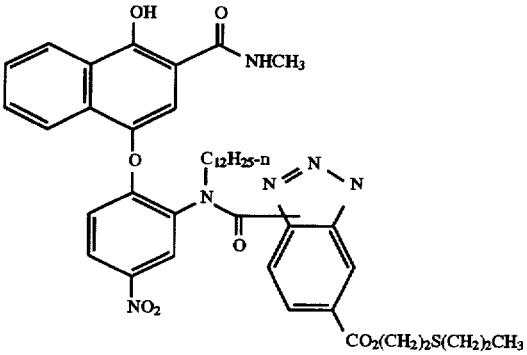

D-35

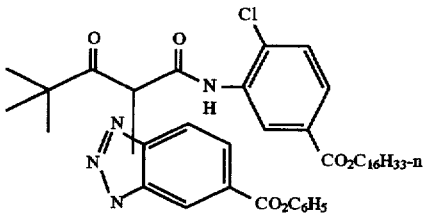

-continued

DYE-6

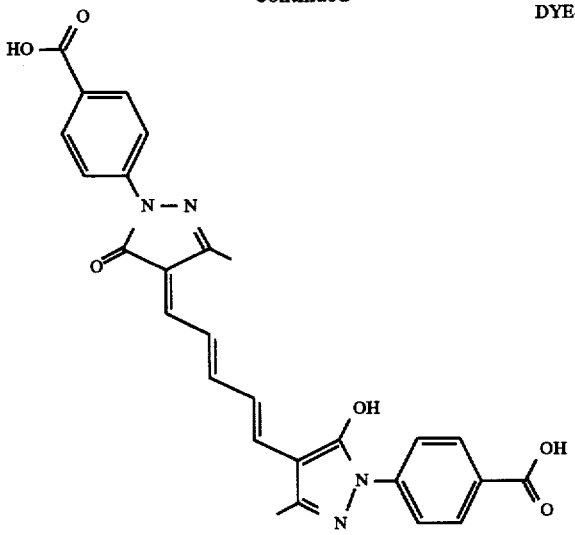

DYE-8

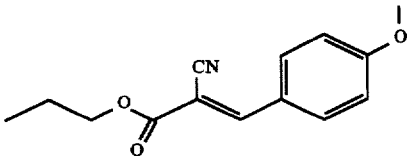

DYE-9

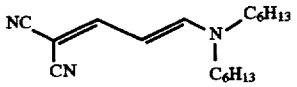

SOL-1

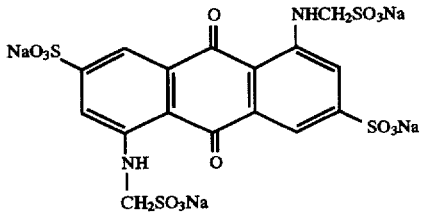

SOL-2

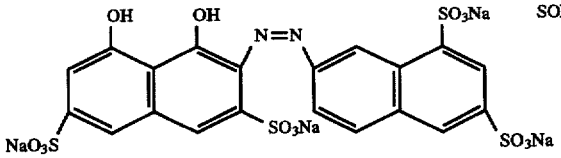

Anhydro-4',5'-benzo-3,3'-bis(3-sulfopropyl)-5,6-dimethyl-9-ethyl-oxathiocarbocyanine hydroxide, triethylammonium salt

SS-1

Anhydro-3,3'-bis(3-sulfopropyl)-5,5'-dichloro-9-ethyl-thiacarbocyanine hydroxide, triethylammonium salt

SS-2

Anhydro-5',6'-dimethoxy-9-ethyl-5-phenyl-3-(3-sulfobutyl)-3'-(3-sulfopropyl)-oxathiacarbocyanine hydroxide, sodium salt

SS-3

Anhydro-5-chloro-9-ethyl-5'-phenyl-3'-(3-sulfobutyl)-3-(3-sulfopropyl)oxacarbocyanine hydroxide, triethylammonium salt

SS-4

Anhydro-3,9-diethyl-3'-methylsulfonylcarbamoylmethyl-5-phenyloxathiocarbocyanine hydroxide

SS-5

Anhydro-3'-methyl-4'-phenyl-3-(3-sulfopropyl)-naphtho[1,2-d]thiazolothiazolocyanine hydroxide

SS-6

Anhydro-4,5-benzo-3,3'-bis(3-sulfopropyl)naphtho-[1,2-d]thiazolothiacyanine hydroxide, sodium salt

SS-7

Anhydro-3,3'-bis(3-sulfopropyl)-4'-phenylnaphto-[1,2-d]thiazolothiazolocyanine hydroxide, triethylammonium salt Anhydro-3,3'-bis(2-sulfoethyl)-5,6-dimethoxy-5'-phenylthiacyanine, triethylammonium salt

SS-9

2,5-Dioctylhydroquinone

ST-4

2-butoxy-N,N-dibutyl-5-octylpyridine

ST-5

Potassium 4-iso-heptadecyl-3,5-dihydroxyphenylsulfonate

ST-16

The following color recording elements were prepared for comparative testing:

Element 101

This element was constructed as described above. No thioether moiety containing glycolic ether was present.

Element 102

This element was constructed like Element 101, except that the thioether moiety containing glycolic ether TE-19 was added to layers (10) and (11) in the amount of 4 grams per silver mole.

Element 103

This element was constructed like Element 102, except that TE-19 was added to layers (2), (3) and (4) in the amount of 4 grams per silver mole.

Element 104

This element was constructed like Element 103, except that TE-19 was added to layers (6), (7) and (8) in the amount of 4 grams per silver mole.

Element 105

This element was constructed like Element 101, except that TE-19 was added to layer (2) in the amount of 4 grams per silver mole in the red recording layer unit.

Samples of Elements 101–105 were exposed to light through a graduated density test object and processed as follows:

| | | | |
|---|---|---|---|
| Develop | 90 sec. | Developer I | 38° C. |
| Bleach | 240 sec. | Bleach I | 38° C. |
| Wash | 180 sec. | water | ca. 35° C. |
| Fix | 240 sec. | Fix I | 38° C. |

-continued

| | | | |
|---|---|---|---|
| Wash | 180 sec. | water | ca. 35° C. |
| Rinse | 60 sec. | Rinse I | ca. 35° C. |

Developer-I was formulated by adding water, 34.3 g of potassium carbonate, 2.32 g of potassium bicarbonate, 0.38 g of anhydrous sodium sulfite, 2.96 g of sodium metabisulfite, 1.2 g of potassium iodide, 1.31 g of sodium bromide, 8.43 g of a 40% solution of diethylenetriaminepentaacetic acid pentasodium salt, 2.41 g of hydroxylamine sulfate, 4.52 g of (N-(4-amino-3-methylphenyl)-N-ethyl-2-aminoethanol) as its sulfuric acid salt and sufficient additional water and sulfuric acid or potassium hydroxide to make 1 L of solution at a pH of 10.00±0.05 at 26.7° C.

Bleach-I was formulated by adding water, 37.4 g of 1,3-propylenediamine tetraacetic acid, 70 g of a 57% ammonium hydroxide solution, 80 g of acetic acid, 0.8 g of 2-hydroxy-1,3-propylenediamine tetraacetic acid, 25 g of ammonium bromide, 44.85 g of ferric nitrate nonanhydrate an sufficient water and acid or base to make 1 L of solution at a pH of 4.75.

Fix-I was formulated by adding water, 214 g of a 58% solution of ammonium thiosulfate, 1.29 g of (ethylenedinitrilo)tetraacetic acid disodium salt dihydrate, 11 g of sodium metabisulfite, 4.7 g of a 50% solution of sodium hydroxide and sufficient water and acid or base to make 1 L of solution at a pH 6.5.

Rinse I was formulated by adding 3.0 mL of KODAK-Photo-Flo 200™ to 900 mL of water and then adding water to a volume of 1 L.

After processing as described above, the status M red, green and blue densities of all five samples were determined as a function of incident exposure. The changes in minimum density (ΔDmin) and in the image density range (ΔDx–Dn), relative gamma (γ), and relative sensitivities of each color record were then determined as described earlier. These results are listed in TABLE-II below.

TABLE II

| Sample | TE-19 | Δ Dmin | Δ Dx-Dn | Relative Sensitivity | Relative γ |
|---|---|---|---|---|---|
| 101-control | | | | | |
| Red | no | check | check(2.21) | 100% | 100% |
| Green | no | check | check(2.38) | 100% | 100% |
| Blue | no | check | check(2.40) | 100% | 100% |
| 102-control | | | | | |
| Red | no | +0.01 | −0.03 | 105% | 93% |
| Green | no | +0.02 | +0.05 | 111% | 103% |
| Blue | yes | +0.09 | −0.10 | 31% | 132% |
| 103-control | | | | | |
| Red | yes | +0.01 | +0.13 | 103% | 111% |
| Green | no | +0.02 | +0.07 | 119% | 107% |
| Blue | yes | +0.09 | −0.08 | 36% | 138% |
| 104-control | | | | | |
| Red | yes | +0.02 | +0.09 | 89% | 105% |
| Green | yes | +0.06 | +0.03 | 104% | 100% |
| Blue | yes | +0.09 | −0.10 | 31% | 133% |
| 105-invention | | | | | |
| Red | yes | 0.0 | +0.19 | 109% | 106% |
| Green | no | +0.01 | +0.09 | 103% | 102% |
| Blue | no | +0.01 | +0.09 | 104% | 102% |

From Table II it is apparent that it is only with Photographic Sample 105, the color recording photographic element with the thioether moiety containing glycolic ether (TE-19) located in the layer unit nearest the support and absent from the layer unit farthest from the support that the imaging density range, sensitivity and gamma are simultaneously improved, all without significantly increasing minimum density. Surprisingly, locating the thioether moiety containing glycolic ether in the layer unit coated farthest from the support rather than nearer the support degraded performance. Even more surprising was the observation that employing the glycolic ether in the layer units coated nearest and farthest from the support and, alternatively, in all of the layer units both degraded overall photographic performance.

EXAMPLE 2

This example has as its purpose (1) to demonstrate varied concentrations of thioether moiety containing glycolic ether and (2) to demonstrate that the performance produced by the glycolic ether in high chloride tabular grain emulsions does not carry over to silver iodobromide tabular grain emulsions.

Comparative Photographic Sample 2-1 was prepared by applying to a transparent support:

An emulsion layer comprised of a chemically and spectrally sensitized to green light AgICl tabular grain emulsion (EM-7) having an average grain ECD of ca. 1.0 μm and an average grain thickness of ca. 0.10 μm and comprising ca. 0.55 mole percent iodide, based on silver, with the remainder of the halide being chloride. The emulsion preparation followed the procedure described by Brust et al U.S. Pat. No. 5,314,798. The green spectral sensitizing dye was SS-4+ SS-5 in a 6:1 molar ratio. In addition to the silver halide (0.645) and gelatin (2.96), the layer contained cyan dye-forming coupler C-1 (0.528).

An overcoat layer comprised of gelatin (1.61) and a hardener.

C-1

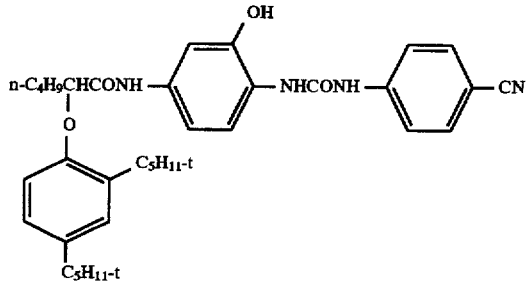

Photographic Sample 2-2 was like Photographic Sample 2-1, except that the emulsion layer additionally comprised 0.030 g per silver mole of the thioether moiety containing glycolic ether TE-19.

Photographic Sample 2-3 was like Photographic Sample 2-1, except that the emulsion layer additionally comprised 0.300 g per silver mole of TE-19.

Photographic Sample 2-4 was like Photographic Sample 2-1, except that the emulsion layer additionally comprised 3.00 g per silver mole of TE-19.

Photographic Samples 2-5 and 2-6 were like Photographic Samples 2-1 and 2-3, respectively, except that the AgICl tabular grain emulsion was replaced by a similarly sized and sensitized conventional AgIBr tabular grain emulsion containing ca. 4.1 mole percent iodide, based on silver. The emulsion was of the type disclosed by Wilgus et al U.S. Pat. No. 4,434,226.

Photographic Samples 2-1 through 2-6 were exposed and processed as described above in Example 1. The results are summarized in TABLE III below.

TABLE III

| Sample/Emulsion | TE-19 g/Ag-mole | Δ Dmin | Relative Sensitivity | Δ Dx − Dn | Relative γ |
|---|---|---|---|---|---|
| 2-1 AgICl | none | check | 100% | check | 100% |
| 2-2 AgICl | 0.03 | +0.21 | 102% | −0.01 | 90% |
| 2-3 AgICl | 0.30 | +0.06 | 115% | +0.16 | 107% |
| 2-4 AgICl | 3.00 | −0.04 | 129% | +0.22 | 120% |
| 2-5 AgIBr | none | check | 100% | check | 100% |
| 2-6 AgIBr | 0.30 | −0.03 | 91% | −0.06 | 97% |

From Table III it is apparent that the concentration of the glycolic thioether was not sufficient to provide an contrast enhancement in Sample 2-2, but was sufficient to satisfy performance requirements in the Samples 2-3 and 2-4.

From Table III it is also apparent that the photographic effects of the glycolic thioether in the high chloride tabular grain emulsion was not predictable from the effects produced in the high bromide tabular grain emulsion, wherein the advantages of the invention were not realized.

EXAMPLE 3

This example has as its purpose to compare the effects of varied high concentration levels of the thioether moiety containing glycolic ether in high chloride tabular grain emulsions and high chloride cubic grain emulsions. Varied spectral sensitizations are also demonstrated.

Emulsion 3-1

A tabular grain silver iodochloride emulsion with an average grain ECD of 3.0 μm and an average grain thickness 0.14 μm was prepared following the procedures described by Brust et al U.S. Pat. No. 5,314,798. The resultant emulsion was 0.55 mole % iodide, based on silver, the remainder of the halide being chloride. The emulsion was optimally sensitized by the customary empirical technique of varying the levels of sensitizing dye, sulfur and gold sensitizers and hold time at elevated temperature. The emulsion was sensitized to red light with SS-3+SS-2 in a 1:9 molar ratio. Sodium thiosulfate pentahydrate and potassium tetrachloroaurate were used as sulfur and gold sensitizers and 70 mg/silver mole of 1-(3-acetamidophenyl)-5-mercaptotetrazole was added after sensitization.

Emulsion 3-2

This emulsion was prepared like Emulsion 3-1, except that the tabular grain silver iodochloride emulsion had an average grain ECD of 0.9 μm and an average grain thickness of 0.09 μm. The emulsion was sensitized similarly as Emulsion 3-1.

Emulsion 3-3

This emulsion was like Emulsion 3-1, except that the emulsion was sensitized to blue light with SS-6+SS-9 added together in a 3.4:1 molar ratio.

Emulsion 3-4

This emulsion was like Emulsion 3-2, except that the emulsion was sensitized to blue light with SS-6+SS-7 added together in a 4:1 molar ratio.

Emulsion 3-5

This emulsion was like Emulsion 3-1, except that the emulsion was sensitized to green light with SS-4+SS-5 added separately with a 20 minute hold between additions.

Emulsion 3-6

A tabular grain silver iodochloride emulsion with an average grain ECD of 1.4 μm and an average grain thickness of 0.12 μm was prepared following the procedures described by Brust et al U.S. Pat. No. 5,314,798. The resultant emulsion was 0.55 mole % iodide, based on silver, and the remainder of the halide being chloride. The emulsion was optimally sensitized similarly as Emulsion 3-1, except that the emulsion was sensitized to green light with SS-4+SS-5 in a 6:1 molar ratio added separately with a 20 minute hold between additions.

Emulsion 3-7

This emulsion was comprised a cubic grain silver chloride emulsion with an average edge length of 0.38 μm, chemically sensitized with gold sulfide and spectrally sensitized to green light with SS-4.

Each sensitized emulsion (Emulsions 3-1 through 3-7) was coated (1.08 silver) onto a cellulose acetate transparent film support over an antihalation layer and a gelatin (4.89) undercoat. The emulsion coating additionally contained cyan dye-forming coupler C-1 (0.97), 4-hydroxy-6-methyl-1,3,3a,7-tetraazaindene (1.75), and gelatin (3.23). The emulsion layer was overcoated with gelatin (4.31), and the entire coating was hardened with bis(vinylsulfonylmethyl)ether at 1.8% by weight of the total coated gelatin. Different quantities of the thioether moiety containing glycolic ether TE-19 were incorporated into different coatings of the emulsion layers, as set out in Table IV to form Photographic Element samples 4-1a through 4-7e.

Green sensitized and red sensitized samples were exposed through a step wedge for 0.01 second with a 3000° K. tungsten light source filtered with a Daylight V and a Kodak Wratten™ 9 filter. Blue sensitized samples were exposed through a step wedge for 0.02 second with a 3000° K. tungsten light source filtered with a Daylight V and a Kodak Wratten™ 2B filter. The samples were processed as in Example 1, except that a 90 second development time was employed.

Photographic performance is summarized in Table IV. High chloride tabular grains are indicated by the symbol ↑Cl Tab and high chloride cubic grains are indicated with the symbol ↑Cl Cube, with a hyphenated suffix to indicate the spectral region of sensitization.

TABLE IV

| Sample | Emulsion | TE-19 (g/Ag-mole) | Δ Dmin | Relative Sensitivity | Relative γ |
|---|---|---|---|---|---|
| 4-1a | ↑Cl Tab-red | NONE | check | 100% | 100% |
| 4-1b | ↑Cl Tab-red | 1.8 | 0.06 | 120% | 96% |
| 4-1c | ↑Cl Tab-red | 3.5 | −0.01 | 135% | 101% |
| 4-1d | ↑Cl Tab-red | 7.1 | −0.01 | 135% | 103% |
| 4-2a | ↑Cl Tab-red | NONE | check | 100% | 100% |
| 4-2b | ↑Cl Tab-red | 1.8 | 0.03 | 141% | 115% |
| 4-2c | ↑Cl Tab-red | 3.5 | 0.0 | 145% | 111% |
| 4-2d | ↑Cl Tab-red | 7.1 | −0.01 | 138% | 119% |
| 4-3a | ↑Cl Tab-blue | NONE | check | 100% | 101% |
| 4-3b | ↑Cl Tab-blue | 1.8 | 0.02 | 112% | 105% |
| 4-3c | ↑Cl Tab-blue | 3.5 | 0.01 | 120% | 101% |
| 4-3d | ↑Cl Tab-blue | 7.1 | 0.01 | 132% | 107% |
| 4-4a | ↑Cl Tab-blue | NONE | check | 100% | 100% |
| 4-4b | ↑Cl Tab-blue | 1.8 | 0.05 | 110% | 111% |
| 4-4c | ↑Cl Tab-blue | 3.5 | 0.03 | 123% | 116% |
| 4-4d | ↑Cl Tab-blue | 7.1 | 0.02 | 135% | 114% |
| 4-5a | ↑Cl Tab-green | NONE | check | 100% | 100% |
| 4-5b | ↑Cl Tab-green | 1.8 | 0.09 | 126% | 93% |

TABLE IV-continued

| Sample | Emulsion | TE-19 (g/Ag-mole) | Δ Dmin | Relative Sensitivity | Relative γ |
|---|---|---|---|---|---|
| 4-5c | ↑Cl Tab-green | 3.5 | 0.06 | 138% | 98% |
| 4-5d | ↑Cl Tab-green | 7.1 | 0.08 | 162% | 91% |
| 4-6a | ↑Cl Tab-green | NONE | check | 100% | 100% |
| 4-6b | ↑Cl Tab-green | 1.8 | 0.03 | 112% | 113% |
| 4-6c | ↑Cl Tab-green | 3.5 | 0.03 | 129% | 112% |
| 4-6d | ↑Cl Tab-green | 7.1 | 0.02 | 155% | 111% |
| 4-7a | ↑Cl Cube-green | NONE | check | 100% | 100% |
| 4-7b | ↑Cl Cube-green | 2 | 0.0 | 102% | 108% |
| 4-7c | ↑Cl Cube-green | 4 | 0.0 | 100% | 105% |
| 4-7d | ↑Cl Cube-green | 8 | 0.0 | 100% | 106% |
| 4-7e | ↑Cl Cube-green | 16 | 0.01 | 93% | 102% |

From Table IV it is apparent that the thioether moiety containing glycolic ether produced large increases in sensitivity and, in most instances, significant increases in contrast when incorporated in the high chloride tabular grain emulsions. On the other hand, incorporation of the same glycolic ether in the cubic grain emulsion produced very limited, if any, increase in sensitivity. This demonstrated that the photographic effects the glycolic ether were not predictable from incorporation in high chloride emulsions other than tabular grain emulsions.

The invention has been described in detail with particular reference to preferred embodiments thereof, but it will be understood that variations and modifications can be effected within the spirit and scope of the invention.

What is claimed is:

1. A color recording photographic element comprised of a support and, superimposed on the support, blue, green and red recording layer units each containing at least one silver halide emulsion, wherein the layer unit nearest the support contains a high chloride tabular grain emulsion and an optionally esterified glycolic ether having a molecular weight of at least 300 and containing at least one thioether moiety and the layer unit farthest from the support is free of the thioether moiety containing glycolic ether.

2. A color recording photographic element according to claim 1 wherein the support is a transparent film support.

3. A color recording photographic element according to claim 1 wherein the support is a white reflective support.

4. A color recording photographic element according to claim 1 wherein the high chloride tabular grain emulsion contains tabular grains that account for at least 70 percent of total grain projected area, exhibit an average aspect ratio of at least 5, and have an average thickness of less than 0.3 μm.

5. A color recording photographic element according to claim 4 wherein the high chloride tabular grain emulsion contains tabular grains that account for at least 90 percent of total grain projected area, exhibit an average aspect ratio in the range of from 8 to 50, exhibit an average thickness of less than 0.2 μm, and contain up to 8 mole percent iodide, based on silver.

6. A color recording photographic element according to claim 1 wherein the thioether moiety containing glycolic ether is present in a concentration of at least 150 mg per silver mole present in the layer unit.

7. A color recording photographic element according to claim 6 wherein the thioether moiety containing glycolic ether is present in a concentration of greater than 3 grams per silver mole present in the layer unit.

8. A color recording photographic element according to claim 1 wherein the glycolic ether is esterified with a carboxylic or thiacarboxylic acid.

9. A color recording photographic element according to claim 8 wherein glycolic ether is a polyester satisfying the formula:

$$-O-\overset{O}{\overset{\|}{C}}-L^1-\overset{O}{\overset{\|}{C}}-O-L^2-$$

where $L^1$ and $L^2$ are hydrocarbon linkages containing from 1 to 20 carbon atoms, with the proviso that at least one of $L^1$ and $L^2$ contain a thioether moiety.

10. A color recording photographic element according to claim 9 wherein $L^1$ and $L^2$ are alkylene or thiaalkylene linkages containing from 1 to 20 carbon atoms, with the proviso that at least one of $L^1$ and $L^2$ contain a thioether moiety.

11. A color recording photographic element according to claim 1 wherein the thioether moiety satisfies the formula:

$$-(CH_2)_m-S-(CH_2)_n-$$

where m and n are independently selected integers, preferably ranging from 2 to 8.

12. A color recording photographic element according to claim 1 wherein the thioether moiety containing glycolic ether satisfies the formula:

$$H[OCH_2CH_2SCH_2CH_2O\overset{O}{\overset{\|}{C}}(CH_2)_3\overset{O}{\overset{\|}{C}}]_yOH$$

where y is chosen to provide an overall molecular weight of 4000 to 8000.

13. A color recording photographic element according to claim 1 wherein the glycolic ether is a polyglycol containing at least one thioether moiety.

* * * * *